US006240388B1

(12) United States Patent
Fukuchi

(10) Patent No.: US 6,240,388 B1
(45) Date of Patent: May 29, 2001

(54) AUDIO DATA DECODING DEVICE AND AUDIO DATA CODING/DECODING SYSTEM

(76) Inventor: Hiroyuki Fukuchi, c/o Nippon Steel Corporation, 6-3, Otemachi 2-chome, Chiyoda-ku, Tokyo-to (JP)

( * ) Notice: Subject to any disclaimer, the term of this patent is extended or adjusted under 35 U.S.C. 154(b) by 0 days.

(21) Appl. No.: 08/889,329

(22) Filed: Jul. 8, 1997

(30) Foreign Application Priority Data

Jul. 9, 1996 (JP) ..... 8-198443

(51) Int. Cl.[7] ..... G10L 21/04

(52) U.S. Cl. ..... 704/225; 704/205; 704/258; 704/268

(58) Field of Search ..... 704/225, 205, 704/258, 224, 267, 268

(56) References Cited

U.S. PATENT DOCUMENTS

| | | | | |
|---|---|---|---|---|
| 4,739,514 | | 4/1988 | Short et al. | 381/103 |
| 5,794,179 | * | 8/1998 | Yamabe | 704/205 |
| 5,825,826 | * | 10/1998 | May et al. | 375/295 |
| 5,867,503 | * | 2/1999 | Ohsuga et al. | 375/269 |

OTHER PUBLICATIONS

Johnston, J.D., et al., "Wideband Coding—Perceptual Considerations for Speech and Music".

* cited by examiner

*Primary Examiner*—David R. Hudspeth
*Assistant Examiner*—Daniel Abebe
(74) *Attorney, Agent, or Firm*—Pollock Vande Sande & Amernick

(57) ABSTRACT

An audio data coding device includes a frequency/time converter circuit for decoding audio data in form of decoded frequency-region signal made by time/frequency conversion, and adjusting circuit for adjusting the frequency-region signal prior to frequency/time conversion by the frequency/time converter circuit to enhance specific frequency components contained in the signal. Since adjustment is made in the frequency region, the processing is easily performed.

An audio data coding and decoding system includes a coding device for converting an audio signal into a frequency-region signal by time/frequency conversion and for coding the signal by quantization, and a decoding device for decoding the audio data coded by the coding device. The coding device includes bit assigning circuit for assigning to a specific frequency component signal a bit number larger than that given by calculation based on human acoustic characteristics upon bit assignment to each frequency component signal for quantization, and the decoding device includes adjusting means for adjusting the frequency-region signal to enhance specific frequency components upon dequantization prior to frequency/time conversion.

15 Claims, 13 Drawing Sheets

FREQUENCY COMPONENTS
BEFORE ADJUSTMENT

FREQUENCY COMPONENTS
AFTER ADJUSTMENT

| INDEX | FLOATING COEFFICIENT | INDEX | FLOATING COEFFICIENT |
|---|---|---|---|
| 0 | 2.00000000000000 | 31 | 0.00155019633981 |
| 1 | 1.58740105196820 | 32 | 0.00123039165029 |
| 2 | 1.25992104989487 | 33 | 0.00097656250000 |
| 3 | 1.00000000000000 | 34 | 0.00077509816991 |
| 4 | 0.79370052598410 | 35 | 0.00061519582514 |
| 5 | 0.62996052494744 | 36 | 0.00048828125000 |
| 6 | 0.50000000000000 | 37 | 0.00038754908495 |
| 7 | 0.39685026299205 | 38 | 0.00030759791257 |
| 8 | 0.31498026247372 | 39 | 0.00024414062500 |
| 9 | 0.25000000000000 | 40 | 0.00019377454248 |
| 10 | 0.19842513149602 | 41 | 0.00015379895629 |
| 11 | 0.15749013123686 | 42 | 0.00012207031250 |
| 12 | 0.12500000000000 | 43 | 0.00009688727124 |
| 13 | 0.09921256574801 | 44 | 0.00007689947814 |
| 14 | 0.07874506561843 | 45 | 0.00006103515625 |
| 15 | 0.06250000000000 | 46 | 0.00004844363562 |
| 16 | 0.04960628287401 | 47 | 0.00003844973907 |
| 17 | 0.03937253280921 | 48 | 0.00003051757813 |
| 18 | 0.03125000000000 | 49 | 0.00002422181781 |
| 19 | 0.02480314143700 | 50 | 0.00001922486954 |
| 20 | 0.01968626640461 | 51 | 0.00001525878906 |
| 21 | 0.01562500000000 | 52 | 0.00001211090890 |
| 22 | 0.01240157071850 | 53 | 0.00000961243477 |
| 23 | 0.00984313320230 | 54 | 0.00000762939453 |
| 24 | 0.00781250000000 | 55 | 0.00000605545445 |
| 25 | 0.00620078535925 | 56 | 0.00000480621738 |
| 26 | 0.00492156660115 | 57 | 0.00000381469727 |
| 27 | 0.00390625000000 | 58 | 0.00000302772723 |
| 28 | 0.00310039267963 | 59 | 0.00000240310869 |
| 29 | 0.00246078330058 | 60 | 0.00000190734863 |
| 30 | 0.00195312500000 | 61 | 0.00000151386361 |
| | | 62 | 0.00000120155435 |

FIG. 12

AUDIO DATA DECODING DEVICE AND AUDIO DATA CODING/DECODING SYSTEM

BACKGROUND OF THE INVENTION

This invention relates to an audio decoding device for expanding audio data transmitted or recorded on a recording medium in a compressed form upon reproduction of the audio signal, or to an audio coding/decoding system for transmitting audio data, or recording same on a recording medium, in a compressed form, and for reproducing the audio data in the expanded form.

There are various known methods for coding audio signals. One of them converts audio signals by using time/frequency conversion that converts a time region signal into a frequency region signal. Used for time/frequency conversion is, for example, a sub-band filter or MDCT (Modified Discrete Cosine Transform).

General information on sub-band filter coding and MDCT coding are given by, for example, Furui & Sondhi in "Advances in Speech Signal Processing" pp. 109–140, published by Marcel Dekkar (New York) in 1991. Known as a sub-band filter coding system is ISO/IEC 11172-3 which is an international standard called MPEG Audio System, and as a MDCT coding system is AC-3 coding.

FIG. 11 shows a conventional audio coding device.

In FIG. 11, a digital audio signal introduced into an input terminal 31 is converted from a time region signal into a frequency region signal in predetermined intervals of time (the interval of time is hereinbelow referred to as conversion block length) by a time/frequency converting circuit 32, and divided into a plurality of frequency bands to increase the coding efficiency.

The converted frequency-region audio signal is supplied to a quantizing circuit 33 for floating and quantization for individual frequency bands therein. Floating herein pertains to a processing for increasing the value of the effective portion of data by multiplying each data in each divisional band by a common value for up-carrying or down-carrying in order to increase the accuracy of subsequent quantization. Floating is not done when quantization accuracy is immaterial. Apractical example of floating is configured to find one having a largest absolute value among data in each band and to use a floating coefficient to maximize the value within the limit not saturating, i.e., not exceeding "1". FIG. 12 shows examples of floating coefficients used in the ISO/ICE 11172-3 system.

The coding device of FIG. 11 executes floating by using an appropriate value among the floating coefficients of FIG. 12. For example, if the maximum absolute value of data in a frequency band is 0.75, then the device selects 0.79370052598410 as a floating coefficient, which is one of floating coefficients of FIG. 12 and whose reciprocal multiplied by 0.75 is maximum within the limit not exceeding "1", and performs floating by multiplying each data in the bands by the reciprocal of the floating coefficient.

The floating coefficient used in the coding device is actually represented and transmitted by a corresponding index value ("4" in the above example). That is, the index value "4" as a floating coefficient selected for floating by the quantizing circuit 33 is transmitted to a multiplexing circuit 34. For decoding, the same floating coefficient is used among those of FIG. 12.

The digital audio signal introduced to the input terminal 31 is supplied also to an adaptive bit assigning circuit 35. The circuit 35 calculates characteristics of an input signal and determines the number of bits to be assigned for each frequency band in accordance with the signal characteristics. For example, the assigned bit number for each frequency band is determined to vary the quantization accuracy adaptively to inaudibilities by the human acoustic sense.

Known as characteristics of the human acoustic sense are minimum audible characteristics which indicate that low frequency sounds are difficult for persons to hear when the volume level is low because the human acoustic sense is lower in low frequency bands, for example, and masking characteristics which indicate the acoustic sense decreases for frequencies near the peak of a certain frequency spectrum.

The human acoustic sense is used for bit assignment to reduce the entire amount of information by modeling audibilities and inaudibilities for individual frequency bands and by assigning less bits to relatively inaudible frequency components.

The assigned bit number determined by the adaptive bit assigning circuit 35 is output as bit length information to the quantizing circuit 33. The quantizing circuit 33 executes quantization of data after floating, using adaptive bit lengths for individual frequency bands. The quantized audio data from the quantizing circuit 33, floating coefficient and bit length information are multiplexed in the multiplexing circuit 34, and output as coded data from an output terminal 37.

FIG. 13 shows a conventional audio decoding device for expanding the compressed audio data from the audio coding device shown in FIG. 11. FIG. 14 is a diagram showing an audio data decoding circuit 51 contained in FIG. 13 in greater detail.

In FIG. 13, the coded audio data supplied to an input terminal 1 is introduced to the audio data decoding circuit 51. As shown in FIG. 14, the coded audio data enters into a demultiplexing circuit 11 at the input stage of the audio data decoding circuit 51. The demultiplexing circuit 11 divides the multiplexed signals for respective frequency bands into audio data, floating coefficient and bit length information for each band.

The divided audio data is supplied to a dequantizing circuit 12 for dequantization and inverse-floating for each frequency band. Quantization is done using the bit length information for each frequency component divided by the demultiplexing circuit 11. Inverse-floating is done for dequantized data in each frequency band by multiplying the dequantized audio data by the floating coefficient divided by the demultiplexing circuit 11, which is one of index values shown in FIG. 12.

The audio data after dequantization and inverse-floating in the dequantizing circuit 12 is converted from the frequency-region signal into the time-region signal by a frequency/time converting circuit 14. The decoded digital audio signal in form of the time-region signal is output from an output terminal 15 and supplied to a subsequent digital-to-analog converter circuit 3.

The digital audio signal recomposed in the audio data decoding circuit 51 is converted into an analog signal by a digital-to-analog converter circuit 3, then adjusted in volume level by a volume control circuit 4, passed through an output adjusting circuit 52, and output from an output terminal 5. Volume adjustment is done by a user of the audio decoding device as desired through a volume knob or other element, not shown.

As explained above, the human acoustic sense has the nature that low frequency components are difficult to hear when the volume is low. Therefore, when audio signals are reproduced in a low volume, they sound as lacking low frequency components, and give a bad quality of sound to human ears. To remove such phenomenon, the output adjusting circuit 52 makes adjustment to enhance low frequency components depending on information on the selected output volume.

U.S. Pat. No. 4,739,514 discloses a sort of the output adjusting circuit 52. This patent uses a band pass filter for dynamically adjusting low frequency components by analog processing to its time-region signal. This circuit, however, needs a number of operational amplifiers and other analog circuit elements, and inevitably becomes a large-scaled and complex circuit.

The human acoustic sense involves the nature that also high frequency components, in addition to low frequency components, are difficult to hear during reproduction in a low volume level. The above-indicated patent, however, makes adjustment of low frequency components alone. Without adjustment of high frequency components, the quality of sound, as a whole, remains bad even after adjustment of low frequency components.

Although conventional techniques use human acoustic characteristics for bit assignment, it enhances low frequency components in the output adjusting circuit 52 upon reproduction irrespectively of the nature of the original signal components, and causes the reproduced signal to have a property different from the acoustic sense model calculated during coding. As a result, enhanced lowband quantized noise is heard, and hence damages the quality of sound to human ears.

SUMMARY OF THE INVENTION

It is therefore an object of the invention to provide an audio decoding device and an audio coding/decoding system using a simple circuit arrangement and realizing output adjustment promising an excellent quality of sound to the human acoustic sense.

According to a first aspect of the invention, there is provided an audio decoding circuit comprising:

a frequency/time converter circuit for decoding coded audio data in a form of a coded frequency-region signal made by time/frequency conversion and coding; and adjustment means for adjusting the signal in the frequency region to enhance specific frequency components thereof before the frequency/time conversion by said frequency/time converter circuit.

Since the invention executes enhancing adjustment of predetermined frequency components in the frequency region prior to frequency/time conversion, the process is easier than that of the prior art configured to execute enhancing adjustment of predetermined frequency components in the time region.

The invention makes enhancing adjustment not only of low frequency components but also of high frequency components, especially considering that it is difficult for human ears to hear low frequency components and high frequency components when audio reproduction is made in a low volume. Therefore, well-balanced outputs containing both high frequency voices and high frequency voices are realized.

According to a second aspect of the invention, there is provided an audio coding and decoding system comprising a coding device for converting an audio signal into a frequency-region signal by time/frequency conversion and for coding same by quantization, and a decoding device for decoding the audio data coded by the coding device, in which the coding device includes bit assigning means for assigning to a specific frequency component signal a bit number larger than that given by calculation based on human acoustic characteristics upon bit assignment to each frequency component signal for quantization, and the decoding device includes adjusting means for adjusting the frequency-region signal to enhance specific frequency components upon dequantization prior to frequency/time conversion.

In this invention, on the part of the coding device, additional bit numbers are previously assigned to low frequency component signals and high frequency components signals in addition to assigned bit numbers calculated on the basis of human acoustic characteristics. Therefore, the invention minimizes quantized noise of low frequency components or high frequency components caused by enhancing adjustment on the part of the decoding device while assigned bit numbers for low frequency components and high frequency components are adjusted upwardly on the part of the decoding device. Therefore, it can prevent the disadvantage involved in the prior art, namely, undesirable enhancement of low frequency components and high frequency components regardless of the nature of the original signal components during reproduction, and can suppress quantized noise.

BRIEF DESCRIPTION OF THE DRAWINGS

FIG. 12 is a diagram showing floating coefficients;

DESCRIPTION OF THE PREFERRED EMBODIMENTS

Explained below some preferred embodiments of the invention with reference to the drawings.

Figure 1:
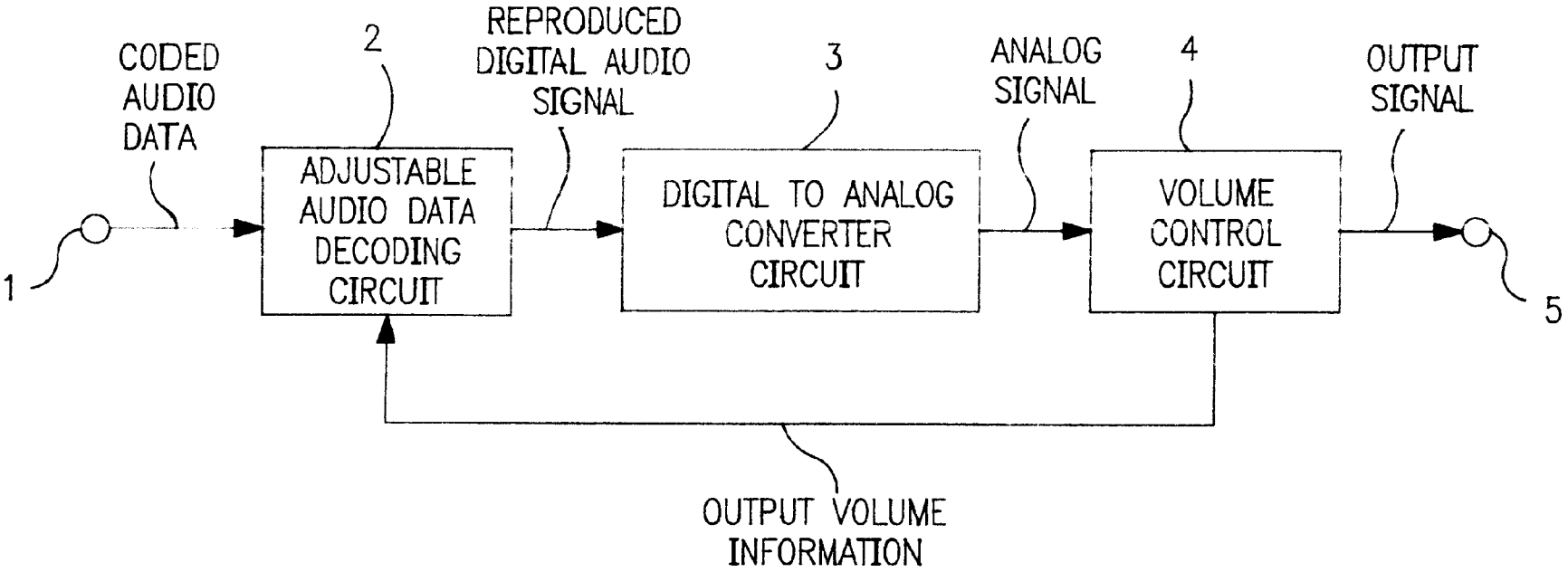
FIG. 1 is a block diagram showing an audio decoding device embodying the invention.
Figure 2:
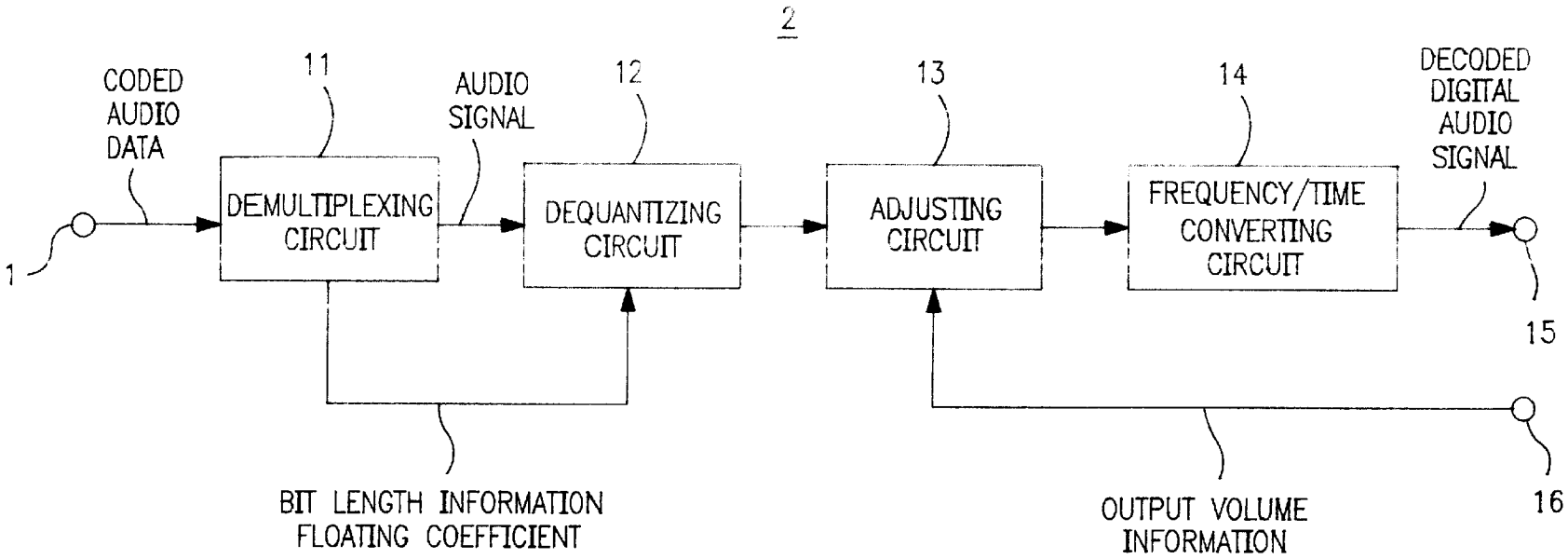
FIG. 2 is a block diagram showing a adjustable audio data decoding circuit, in the device shown in FIG. 1.

FIG. 1 is a block diagram of an audio decoding device embodying the invention. FIG. 2 is a block diagram of a adjustable audio data decoding circuit 2 shown in FIG. 1.

In FIG. 1, coded audio data entering into the input terminal 1 is introduced to an audio data decoding circuit 2 having a adjustable function. The adjustable audio data decoding circuit 2 executes processing for decoding the coded audio data. In the decoding process, the circuit receives output volume information given from the subsequent volume control circuit 4 to indicate a selected output volume level, and makes adjustment explained later.

A digital audio signal reproduced by the adjustable audio data decoding circuit 2 is converted to the analog signal by the DA converter circuit 3, then adjusted in volume level by the volume control circuit 4, and output from the output terminal 5. Volume adjustment is done as desired by a user of the audio decoding device through a volume or other element, not shown.

Next explained are an arrangement of the adjustable audio data decoding circuit and a method for decoding and adjusting the audio data in greater detail with reference to FIG. 2. In FIG. 2, the coded audio data given to the input terminal 1 is introduced to the demultiplexing circuit 11. The circuit 11 divides the multiplexed signal in each frequency band into audio data and bit length information in each band. When floating is made in the coding device, also the floating coefficient is divided from the multiplexed signal.

The divided audio data is supplied to the dequantizing circuit 12 for dequantization and inverse-floating for each frequency band. Dequantization is done based on the bit length information for each frequency component divided by the demultiplexing circuit 11. Inverse-floating is done for dequantized data in each frequency band by multiplying the dequantized audio data by the floating coefficient divided by the demultiplexing circuit 11, which is one of index values shown in FIG. 12.

The frequency-region audio signal after dequantization, with or without back-floating, in the dequantizing circuit 12 is supplied to the adjusting circuit 13, and undergoes enhancing adjustment to low frequency components and high frequency components. The adjusted audio signal is converted from the frequency-region signal to the time-region signal in the frequency/time converter circuit 14, and the re-composed digital audio signal is output from the output terminal 15 and supplied to the subsequent digital-to-analog converter circuit 3.

Adjustment by the adjusting circuit 13 is to enhance predetermined frequency components in accordance with output volume information introduced through the input terminal 16.

Figure 3:
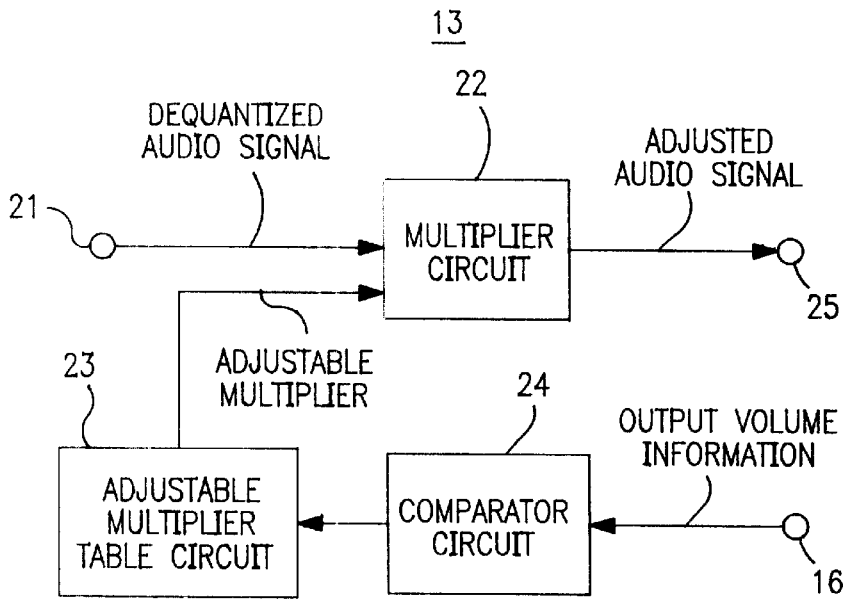
FIG. 3 is a block diagram of a adjusting circuit used in the circuit shown in FIG. 2.

FIG. 3 is a block diagram of an arrangement of the adjusting circuit 13 for realizing enhancing adjustment in case where the audio signal after dequantization and inverse-floating by the dequantizing circuit 12 is corrected.

In FIG. 3, the dequantized audio signal introduced through the input terminal 21 is sent to a multiplier circuit 22. The output volume information entering through the input terminal 16 is introduced to the comparator circuit 24. Then, the adjusting circuit 13 specifies the output volume and the frequency, and outputs them to the adjustable multiplier table circuit 23. The adjustable multiplier table circuit 23 stores various adjustable multipliers for different output volumes and frequencies. That is, the adjustable multiplier table circuit 23 stores, as table information, adjustable multipliers for enhancement adjustment of low frequency components and high frequency components when a selected output volume level is low. The table circuit 23 may store a fixed adjustable multiplier (for example, 2.0) for output volume levels smaller than a certain value, or may store more adjustable multipliers whose values increase as the output volume level becomes low. Information on the output volume level is extracted, depending on the rotating angle of a volume control knob or a resistance value responsive to the angle, for example.

Figure 4:
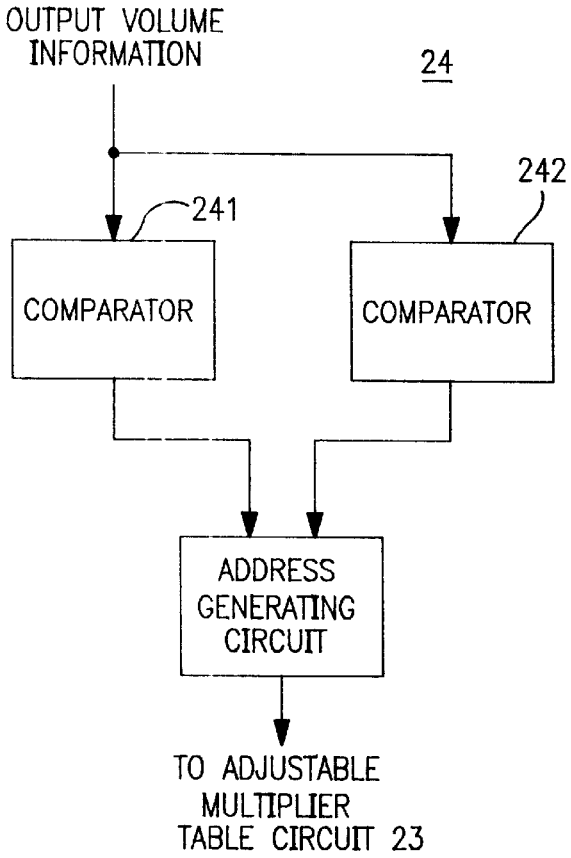
FIG. 4 is a block diagram of a comparator circuit used in the circuit shown in FIG. 3.

FIG. 4 shows an arrangement of the comparator circuit 24 of FIG. 3 in greater detail.

The comparator circuit 24 includes two comparators 241, 242 which receive output volume information as an input signal of the adjusting circuit 13 and compare them with predetermined reference values, and an address generator circuit 243 which generates address data to the adjustable multiplier table circuit 23 in response to the results of comparison by the comparators 241, 242.

Following adjustable coefficients are selected 1.0 when output>THR1

2.0 when THR1≧output>THR2

4.0 when THR1≧output where THR1 is the reference value for high volume levels in which the output volume need not be corrected, and THR2 is the reference value of low volume levels which need intensive correction. The adjustable multiplier table circuit 23 stores these adjustable coefficients, and the address generating circuit 243 creates and outputs address data adaptive for the adjustable coefficients in response to results of comparison by the comparators 241, 242. For example, the comparator 241 may use THR1 as its reference value to output "1" for a higher volume level and "0" for a lower volume level, and the comparator 242 may use THR2 as its reference level to output "1" for a higher volume level and "0" for a lower volume level, so that combinations of these outputs, "00", "01" and "11", be used as address data of the adjustable multiplier table circuit 23.

For reading out adjustable coefficients, more materials for comparison and more reference values may be used to read out and supply difference values between a low frequency component and a high frequency component, for example.

In this manner, the comparator circuit 24 selects and reads out appropriate one of various adjustable multipliers stored in the adjustable multiplier table circuit 23 in response to its output, and supplies it to the multiplier circuit 22.

The multiplier circuit 22 multiplies the dequantized audio signal by a adjustable multiplier selected by the comparator circuit 24. Adjustable multiplier 1.0 is one for output volume levels not so small, or in a region outside the low frequency region and high frequency region, and not requiring correction. Therefore, the adjusting circuit 13 outputs the dequantized audio signal without correction.

The multiplier circuit 22 used in this example may be replaced by a shift circuit with a simpler construction. It is also possible, in order to decrease the scale of the adjustable multiplier table circuit 23, to block the audio signal dequantized in the frequency region into predetermined units and to store a common adjustable multiplier value in each block so as to reduce the total number of adjustable multipliers.

Since this embodiment enhances low frequency components and high frequency components of the signal in the frequency region by a digital process, the circuit scale can be made smaller and simpler than conventional one. Additionally, since this embodiment executes enhancing adjustment to both low frequency components and high frequency components, voices of both low frequency components and high frequency components sound better, and the quality of sound to the human acoustic sense is improved.

Figure 5:
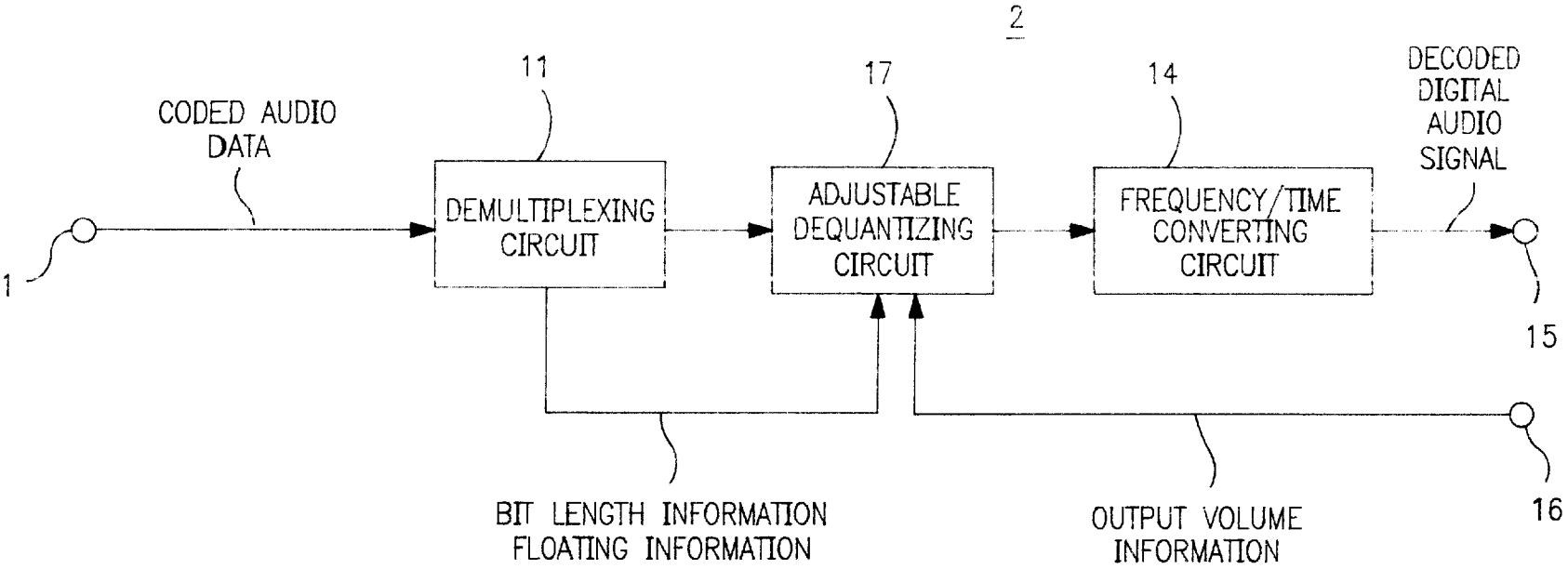
FIG. 5 is a block diagram of another example of the adjustable audio data decoding circuit used in the device shown in FIG. 1.

FIG. 5 is a block diagram of another arrangement of the adjustable audio data decoding circuit 2 used in the device shown in FIG. 1.

In FIG. 5, the coded audio data introduced through the input terminal is divided by the demultiplexing circuit 11. Divided audio data is supplied to the adjustable dequantizing circuit 17, and bit length information and floating information are introduced to the dequantizing circuit 17 as information for controlling dequantization of the circuit 17. The dequantizing circuit 17 performs dequantization and inverse-floating for each frequency band. The adjustable dequantization circuit 17 also performs enhancing adjustment to frequency components and high frequency components of the audio signal in the frequency region.

The adjusted audio signal is next converted from the frequency-region signal into a time-region signal by the frequency/time converter circuit 14, and the re-composed digital audio signal is supplied to the subsequent Da converter circuit 3 through the output terminal 15.

Typical methods of adjustment by the adjustable dequantizing circuit 17 are, for example, (1) multiplying the dequantized audio signal before inverse-floating by a predetermined coefficient depending on the output volume level; and (2) multiplying the floating coefficient by a predetermined coefficient.

When adjustment is made to the floating coefficient like the method in (2) above, a smaller adjusting circuit can be made. That is, as explained with the prior art, it is the indices of the reference table, and not the floating coefficients, that are multiplexed with audio data upon coding.

Therefore, multiplying a floating coefficient by 2.0 when using the table shown in FIG. 12 makes the same result as decreasing the multiplexed index value by 3 and multiplying the floating coefficient by 2.0 upon adjustment. Since this process can attain adjustment only with an adder circuit, and not a multiplier circuit, the scale of the circuit can be reduced significantly.

Figure 6:
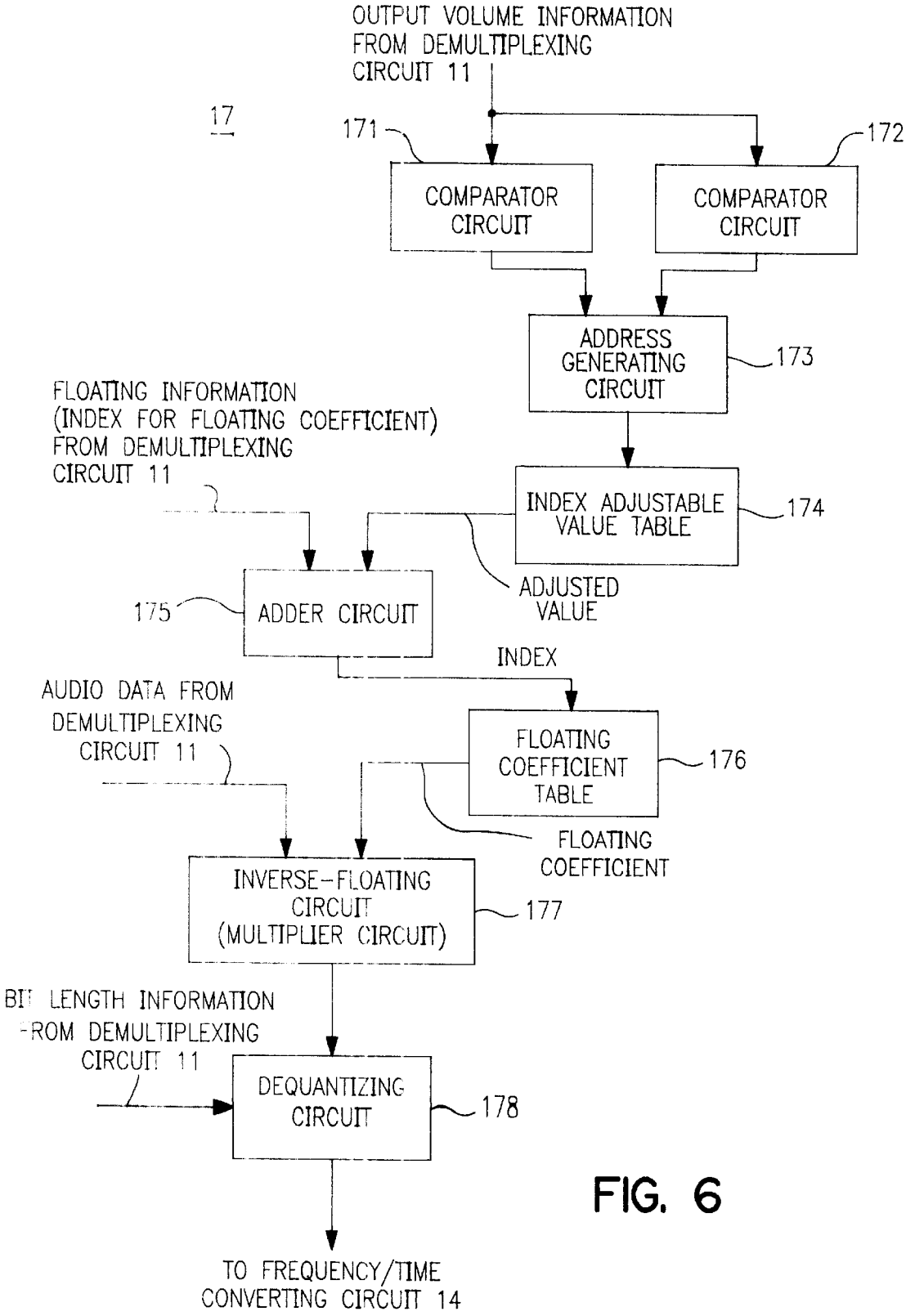
FIG. 6 is a block diagram of a adjustable dequantizing circuit used in the circuit of FIG. 5.

FIG. 6 is a block diagram of an arrangement of the adjustable dequantizing circuit 17 configured to make adjustment to floating coefficients.

Output volume information from the demultiplexing circuit 11 is given to two comparators 171, 172, and results of comparison with their reference values are given to the address generating circuit 173. Construction and behaviors of these circuits are the same as those of the comparator circuit 24, and not explained here for avoid redundancy.

Based on results of comparison from the comparator circuits 171 and 172, the address generating circuit 173 outputs address data to the index adjustable value table 174, and the index adjustable value table 174 outputs to the adder circuit 175 a adjustable value corresponding to the address data. The adder circuit 175 adds the adjustable value to the floating information from the demultiplexing circuit 11, and supplies the added value as an index to the floating coefficient table 176. The floating coefficient table 176 stores floating coefficients for various indices in form of a table, and outputs to the multiplier circuit 177 behaving as a inverse-floating circuit a floating coefficient for the adjusted index output from the adder circuit 175. The inverse-floating circuit 177 is also supplied with audio data from the demultiplexing circuit 11, and executes inverse-floating by multiplying the audio data by a floating coefficient. Output of the multiplier circuit 177 is given to the dequantizing circuit 178 which dequantizes the input data, using the bit length information output from the demultiplexing circuit 11, and supplies the dequantized audio data.

Figure 7A:
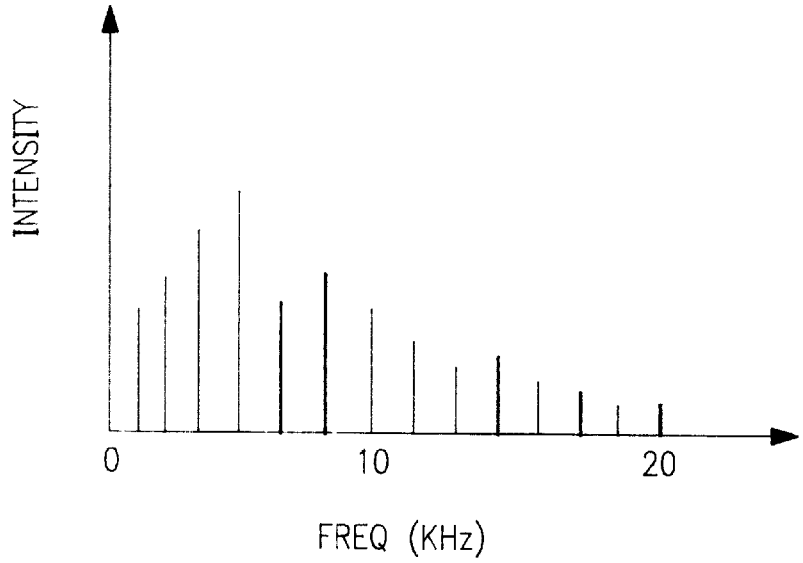
FIGS. 7A and 7B are diagrams showing changes of frequency components by enhancement correction.
Figure 7B:
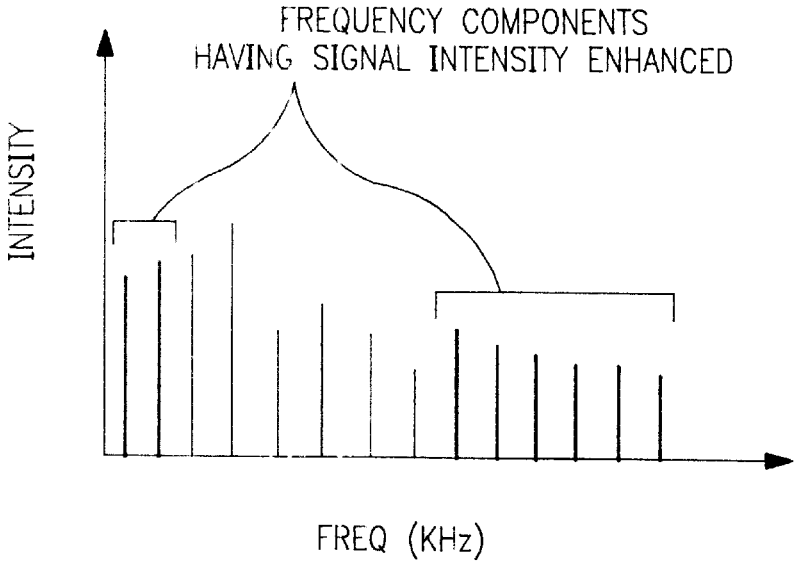

FIGS. 7A and 7B are spectral diagrams showing changes of frequency components as a result of enhancing adjustment explained above. For example, assume that a dequantized audio signal containing frequency components shown in FIG. 7A enters in the adjusting circuit 13 shown in FIG. 2. The adjusting circuit 13 enhances the frequency components shown by solid lines in FIG. 7B. The quality of sound during low volume reproduction can be improved by enhancing, for example, frequency components below 1 kHz and frequency components above 10 kHz by 4 to 10 dB.

The audio decoding device embodying the invention has been explained above as containing the digital-to-analog converter circuit 3 and outputting analog signals. However, this is not indispensable, and the entirety of the device may be made of digital circuits.

Next explained is an audio coding device according to another aspect of the invention.

Figure 8:
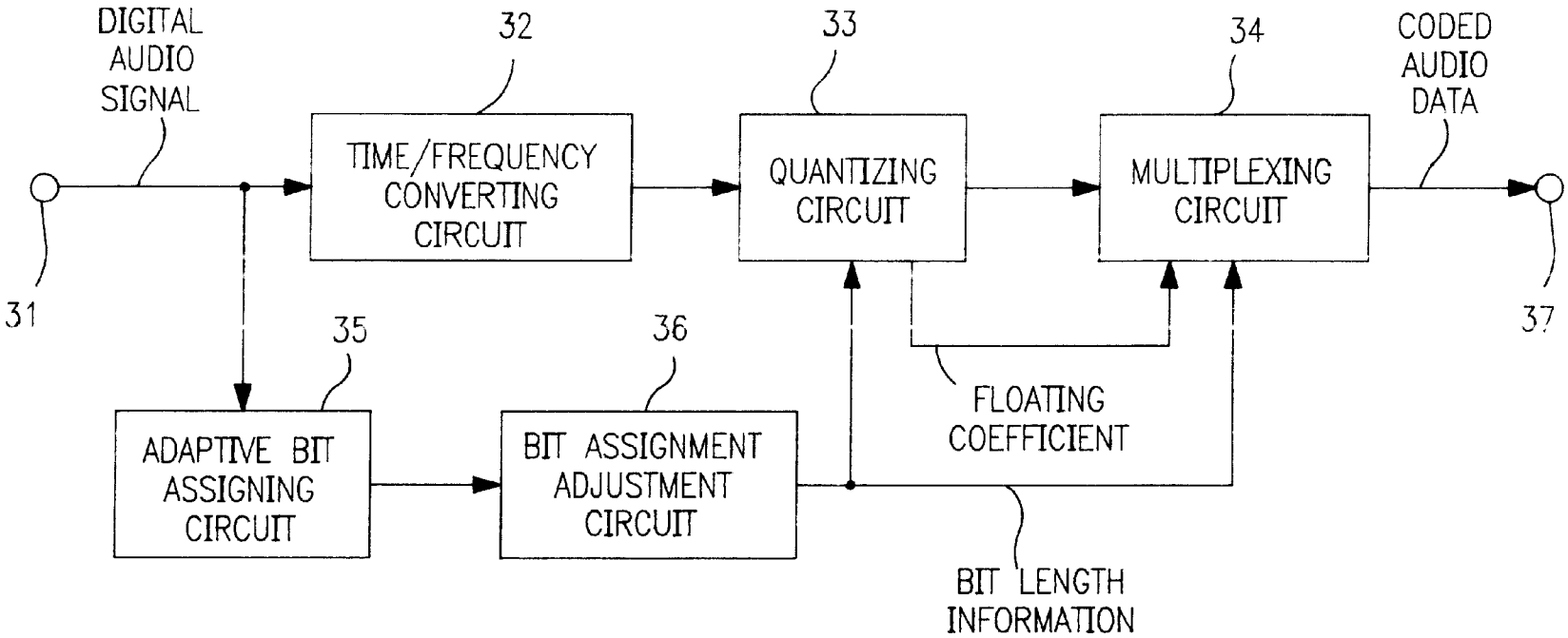
FIG. 8 is a block diagram of an audio coding device embodying the invention.

FIG. 8 is a block diagram showing an arrangement of the audio coding device embodying the invention. A digital audio signal entering into the input terminal 31 is converted from a time-region signal into a frequency-region signal in predetermined intervals of time by the time/frequency converter circuit 32. In this process, the audio signal is divided into a plurality of frequency bands to increase the coding efficiency.

The converted frequency-region audio signal is supplied to the quantizing circuit 33. The quantizing circuit 33 executes floating and quantization of the audio signal for each frequency band. Used for the floating is an appropriate value selected from floating coefficients explained with reference to FIG. 12.

The digital audio signal entering into the input terminal 31 is supplied also to the adaptive bit assigning circuit 35.

Figure 9:
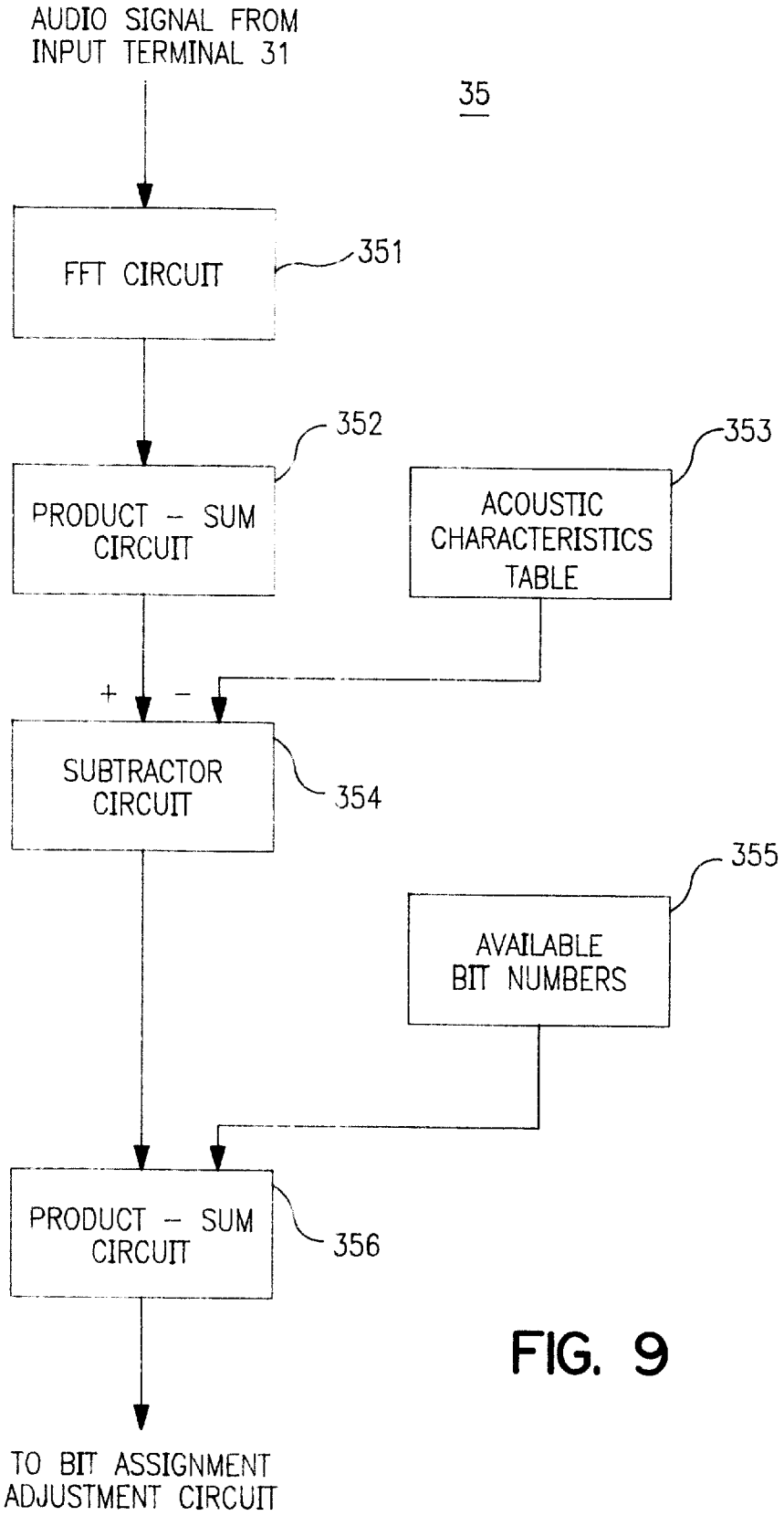
FIG. 9 is a block diagram of an adaptive bit assigning circuit used in the device shown in FIG. 8.

FIG. 9 is a block diagram of an arrangement of the adaptive bit assigning circuit 35.

The digital audio signal introduced through the input terminal 31 first undergoes Fourier transformation in the fast Fourier transformer (FFT) 351, and product-sum operation is done in the product-sum circuit 352. The subtractor circuit 356 takes a difference between output of the product-sum circuit 352 and output from the acoustic characteristics table 353 storing adjusted values according to acoustic characteristics, and supplies its output to another product-sum circuit 356. The product-sum circuit 356 executes product-sum operation of the output from the subtractor circuit 354 and output of the memory 355 storing available bit numbers for individual frequency bands, and supplies its output to the bit assignment adjusting circuit 36.

Therefore, the adaptive bit assigning circuit 36 determines assigned bit numbers for respective frequency bands so as to vary the quantization accuracy adaptively to inaudibilities due to human acoustic characteristics.

When the human acoustic characteristics are used for bit assignment, quantization accuracies of low frequency components and high frequency components are rough. As a result, the above-explained enhancing adjustment executed on the part of the decoding device may audibly enhance quantized noise and rather deteriorates the quality of sound.

To overcome the problem, the coding device according to the invention previously improves the quantization accuracy by giving output of the adaptive bit assigning circuit to the bit assignment adjusting circuit 36 and by assigning one or more additional bits (for example, one bit) to the low frequency components and high frequency components.

Figure 10:
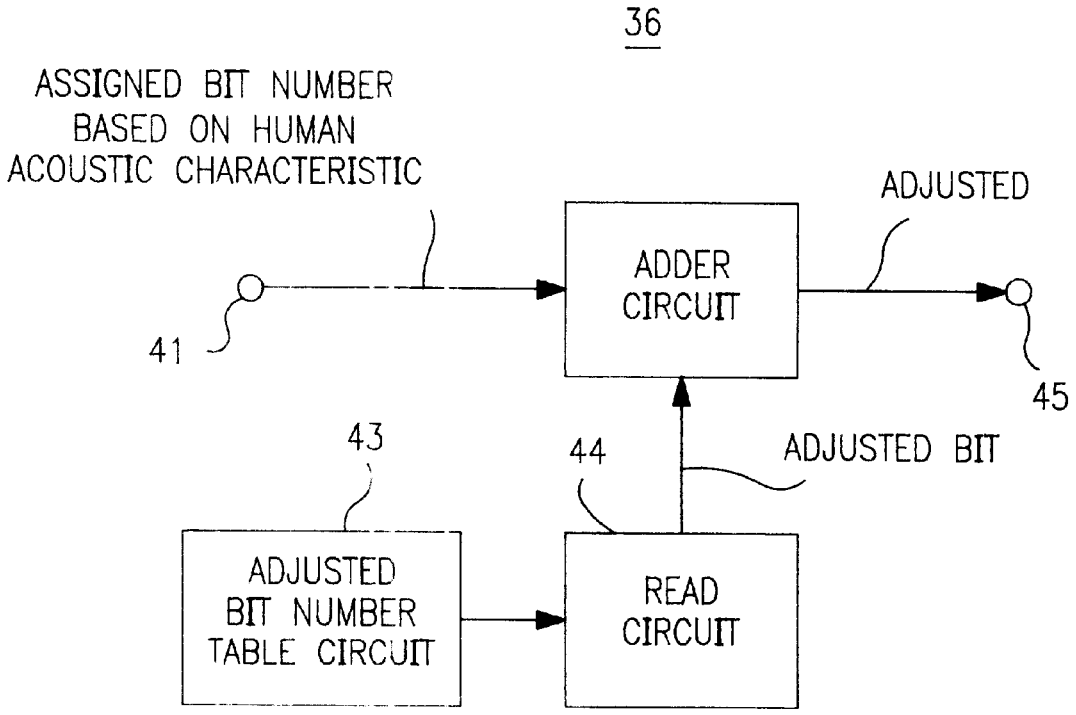
FIG. 10 is a block diagram of a bit assignment adjusting circuit used in the device shown in FIG. 8.
Figure 11:
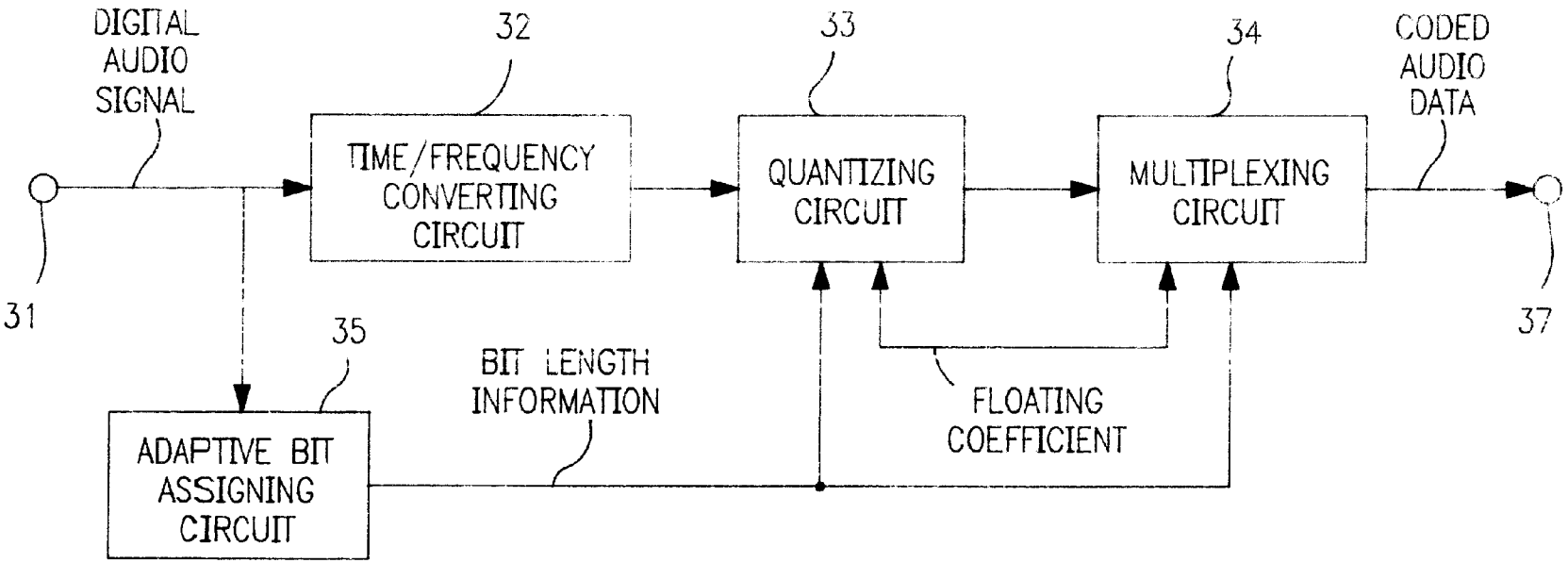
FIG. 11 is a block diagram of a conventional audio coding device.
Figure 13:
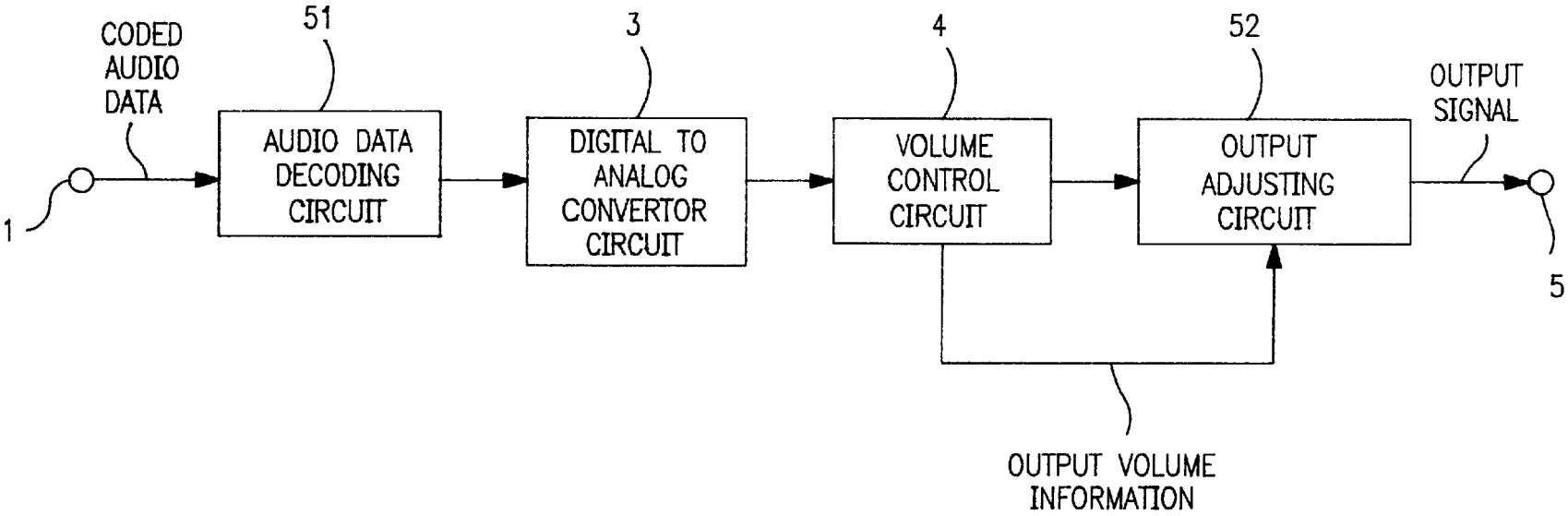
FIG. 13 is a block diagram of a conventional audio decoding device.
Figure 14:
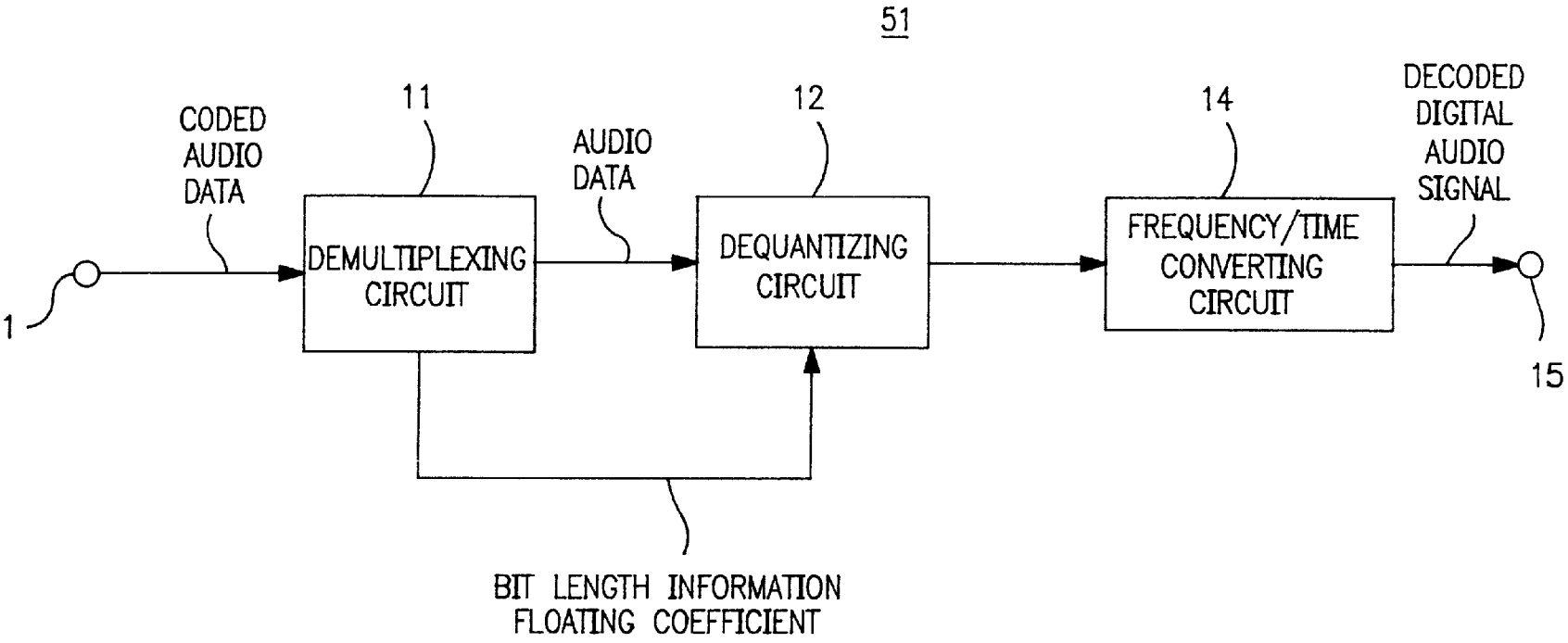
FIG. 14 is a block diagram of an audio data decoding circuit used in the device shown in FIG. 13.

FIG. 10 is a diagram showing an arrangement of the bit alignment adjusting circuit 36.

In FIG. 10, an assigned bit number based on human acoustic characteristics for each frequency band, which is introduced from the adaptive bit assigning circuit 35 through the input terminal 41, is sent to the adder circuit 42. The adder circuit is also supplied with one of adjusted bit numbers read out by the read circuit 44 from the adjusted bit number table circuit 43 which stores adjusted bit numbers for individual frequency bands. The adder circuit 42 produces the sum of the assigned bit number in accordance with human acoustic characteristics and the adjusted bit number for each frequency band, and supplies the sum from the adapt terminal 45 to the quantizing circuit 33 and the multiplexing circuit 34. The quantizing circuit 33 performs quantization of data after floating, using adjusted bit lengths for individual frequency bands.

In this example, if the data need not be corrected, 0 may be used as the adjusted bit number. It is also possible to use different adjusted bit numbers between the low frequency region and the high frequency region.

Although the arrangement of FIG. 6 uses the adaptive bit assigning circuit 35 and the bit assignment adjusting circuit 36 as separate circuits, this may be modified to use a single bit assigning circuit alone which is configured to set assigned bit numbers containing adjustable amounts in consideration of quantized noise.

In this manner, the embodiment upwardly corrects assigned bit numbers for low frequency components and high frequency components on the part of the coding device, and performs enhancing adjustment on the part of the decoding device. As a result, the embodiment can remove the prior art defect that low frequency components and high frequency components are enhanced in reproduced voices regardless of the nature of the original signal components, and can therefore suppress quantized noise.

What is claimed is:

1. An audio data decoding device comprising:

a frequency/time converter circuit for decoding coded audio data in a form of a coded frequency-region signal made by time/frequency conversion and coding; and adjustment means for adjusting the signal in the frequency region to enhance specific frequency components thereof before the frequency/time conversion by said frequency/time converter circuit, wherein said adjusting means enhances said specific frequency components on the basis of volume information obtained from the decoded audio data.

2. The audio data decoding device according to claim 1, wherein said specific frequency components are low frequency components and high frequency components which are less audible due to human acoustic characteristics when the audio data is reproduced in a low volume.

3. An audio data decoding device comprising:

a frequency/time converter circuit for decoding audio data in form of a coded time-region signal made by frequency/time conversion and quantization including floating processing;

a dequantizing circuit for dequantizing the audio data prior to frequency/time conversion by said frequency/time converter circuit; and adjusting means interposed between said dequantizing circuit and said frequency/time converter circuit to correct the audio data to enhance specific frequency components thereof.

4. The audio data decoding device according to claim 3, wherein said adjusting means enhances quantized data of predetermined frequency components in the process for dequantization prior to said frequency/time conversion.

5. The audio data decoding device according to claim 4, wherein said adjusting means enhances floating coefficients of predetermined frequency components in the process for dequantization prior to said frequency/time conversion.

6. The audio data decoding device according to claim 3, wherein said specific frequency components are low frequency components and high frequency components which are less audible due to human acoustic characteristics when the audio data is reproduced in a low volume.

7. The audio data decoding device according to claim 3, wherein said dequantizing circuit and said adjusting circuit is a single unitary circuit.

8. An audio data coding and decoding system comprising:

a coding device for converting an audio signal into a frequency-region signal by time/frequency conversion and for coding same by quantization; and a decoding device for decoding the audio data coded by the coding device, said coding device including bit assigning means for assigning to a specific frequency component signal a bit number larger than that given by calculation based on human acoustic characteristics upon bit assignment to each frequency component signal for quantization, said decoding device including adjusting means for adjusting the frequency-region signal to enhance said specific frequency components upon dequantization prior to frequency/time conversion.

9. The audio data coding and decoding system according to claim 8, wherein said specific frequency components are low frequency components and high-frequency components which are less audible due to human acoustic characteristics when the audio data is reproduced in a low volume.

10. The audio data coding and decoding system according to claim 8 wherein said decoding device includes volume control means for adjusting the output volume, said adjusting means in said decoding device adjusting the frequency-region signal prior to frequency/time conversion to enhance low frequency components and high frequency components which are less audible due to human acoustic characteristics when the signal is reproduced in a low volume, when output volume information indicating a low volume is set in said volume control means.

11. The audio data coding and decoding system according to claim 9, wherein said quantization executed in said coding device includes floating processing, and said adjusting means in said decoding device enhances quantized data of said low frequency components and high frequency components in the process for dequantization.

12. The audio data coding and decoding system according to claim 11, wherein said quantization executed in said coding device includes floating processing, and said adjusting means in said decoding device enhances floating coefficients of said low frequency components and said high frequency components in the process for dequantization.

13. An audio data decoding device comprising:

a frequency/time converter circuit for decoding coded audio data in a form of a coded frequency-region signal made by time/frequency conversion and coding; and adjustment means for adjusting the signal in the frequency region to enhance specific frequency components thereof before the frequency/time conversion by said frequency/time converter circuit, further comprising a volume control means, said adjusting means being responsive to output volume information obtained from said volume control means to enhance said specific frequency components.

14. The audio data decoding device according to claim 13, further comprising a digital-to-analog converter for converting the audio data from the digital audio signal in the time region made by conversion by said frequency/time converter circuit into an analog audio signal, said volume control means adjusting the volume of said analog signal from said digital-to-analog converter.

15. The audio data decoding device according to claim 13 wherein said adjusting circuit includes:

a comparator circuit for comparing said output volume information with a reference value;

a storage circuit for storing adjustable multipliers at addresses specified by outputs of said comparator circuit; and an operational circuit for multiplying the audio signal by a adjustable multiplier read out from said storage circuit.

* * * * *